US007910896B2

(12) United States Patent
Marta et al.

(10) Patent No.: US 7,910,896 B2
(45) Date of Patent: Mar. 22, 2011

(54) MICRO DISCHARGE DEVICE IONIZER AND METHOD OF FABRICATING THE SAME

(75) Inventors: Terry M. Marta, White Bear Lake, MN (US); Fouad Nusseibeh, Champlin, MN (US); Adam Dewey McBrady, Minneapolis, MN (US); Michael Rhodes, Richfield, MN (US)

(73) Assignee: Honeywell International Inc., Morristown, NJ (US)

( * ) Notice: Subject to any disclaimer, the term of this patent is extended or adjusted under 35 U.S.C. 154(b) by 362 days.

(21) Appl. No.: 12/179,969

(22) Filed: Jul. 25, 2008

(65) Prior Publication Data

US 2010/0019139 A1 Jan. 28, 2010

(51) Int. Cl.
*H01J 27/02* (2006.01)

(52) U.S. Cl. ..... 250/424; 250/423 R; 250/288; 313/231.01; 313/231.31; 315/111.01; 315/111.21; 315/111.81; 315/111.91

(58) Field of Classification Search ..... 250/423 R, 250/424, 288; 313/231.01, 231.31; 315/111.01, 315/111.21, 111.81, 111.91
See application file for complete search history.

(56) References Cited

U.S. PATENT DOCUMENTS

| | | | | |
|---|---|---|---|---|
| 6,457,347 | B1 * | 10/2002 | Koo et al. | 73/23.35 |
| 7,000,452 | B2 | 2/2006 | Bonne et al. | 73/23.25 |
| 7,100,421 | B1 * | 9/2006 | Herring | 73/23.35 |
| 7,104,112 | B2 | 9/2006 | Bonne | 73/23.25 |
| 7,367,216 | B2 | 5/2008 | Bonne | 73/25.01 |
| 2002/0171367 | A1 * | 11/2002 | Giapis et al. | 315/111.21 |
| 2004/0144733 | A1 | 7/2004 | Cooper et al. | 210/748 |
| 2004/0245993 | A1 | 12/2004 | Bonne | 324/464 |
| 2006/0201534 | A1 * | 9/2006 | Kurunczi | 134/1.1 |
| 2008/0290799 | A1 * | 11/2008 | Eden et al. | 313/582 |
| 2009/0031785 | A1 * | 2/2009 | Kellner et al. | 73/23.39 |
| 2010/0045159 | A1 * | 2/2010 | McBrady et al. | 313/356 |

* cited by examiner

*Primary Examiner* — Bernard E Souw
*Assistant Examiner* — Michael Maskell
(74) *Attorney, Agent, or Firm* — Kermit D. Lopez; Luis M. Ortiz; Kris T. Fredrick

(57) ABSTRACT

A micro discharge device (MDD) ionizer and a method for fabricating the MDD ionizer are disclosed. The MDD ionizer includes a dielectric barrier having a first open end connected to an electrically conductive capillary tube and a second open end connected to a sample collection capillary tube. A circular high voltage electrode can be positioned around the dielectric barrier in close linear proximity to the conductive capillary tube and sealed by a non-conductive epoxy. A plasma discharge can be formed in a flow path through the dielectric barrier when an AC potential is applied between the high voltage electrode and the electrically conductive capillary tube utilizing an electronic controller. Such a plasma discharge in the flow path of the sample achieves soft ionization of gaseous sample molecules. The high pressure region generally occurs in the plasma region (where the ionization occurs). The ions thus are drawn (i.e., pushed or pulled) toward the high vacuum region located downstream where the detector(s) can be located.

17 Claims, 6 Drawing Sheets

MICRO DISCHARGE DEVICE IONIZER AND METHOD OF FABRICATING THE SAME

TECHNICAL FIELD

Embodiments are generally related to micro discharge devices. Embodiments are also related to micro discharge device ionizers. Embodiments are additionally related to micro discharge device ionizers utilized in the context of micro electro mechanical system (MEMS) based detectors.

BACKGROUND OF THE INVENTION

Ionization is a physical process of converting an atom or molecule of samples into an ion by adding or removing charged particles such as electrons or other ions. Depending on the level of impact energy, electrons may be ejected from atoms and molecules, or the molecules are fractured (i.e., fragmented) into a complement of fragments with diverse charge states. Ionization of gaseous molecules is conventionally initiated by photon bombardment, charged particle impact, ultraviolet radioactive ionization, or by thermal electron beams. Such conventional ionization techniques, however, utilize hard ionization and generate electrons and ions by means of radioactive elements, which are hazardous and not suitable for general applications. In modern low power high sensitive devices and/or detectors, a soft ionization technique is required to ionize the sample molecules at a pressure well above high vacuum regions.

In MEMS-based micro discharge device (MDD) detectors, soft ionization of gaseous samples is highly desirable. A typical MEMS-based detector can be utilized for detecting the presence of molecules in a gas sample on the basis of their optical emission spectrum as excited and emitted by that discharge. In majority of prior art MEMS-based detectors, the ionization sources are less efficient and the lifetime of prior art ionization sources is very short. Also, the ionizers utilized for low power high sensitivity devices are unable to provide soft ionization at pressures well above a high vacuum region. Additionally, MEMS-based detectors require additional power pumps to increase the pressure in the flow path, which utilizes more electrical energy. Therefore, the majority of prior art ionizers provides very low ionization efficiencies and also increases production costs.

Based on the foregoing, it is believed that a need exists for an improved micro discharge device (MDD) ionizer, which achieves soft ionization at high vacuum regions without the need for high power pumps.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved micro discharge device ionizer for soft ionization of gas samples.

It is another aspect of the present invention to provide for a method for fabricating the micro discharge device ionizer.

It is a further aspect of the present invention to provide for an improved micro discharge device ionizer utilized in the context of MEMS-based detectors.

The aforementioned aspects and other objectives and advantages can now be achieved as described herein. A micro discharge device (MDD) ionizer and a method for fabricating the MDD ionizer are disclosed. The MDD ionizer includes a dielectric barrier having a first open end connected to an electrically conductive capillary tube and a second open end connected to a sample collection capillary tube. A circular high voltage electrode can be positioned around the dielectric barrier in close linear proximity to the conductive capillary tube and sealed by a non-conductive epoxy. A plasma discharge can be formed in a flow path of the dielectric barrier when an AC potential is applied between the high voltage electrode and the electrically conductive capillary tube utilizing an electronic controller. Such a plasma discharge in the flow path of the dielectric barrier achieves soft ionization of gaseous sample molecules at high vacuum regions.

Furthermore, the MDD ionizer can be potted in a potting block, which is sealed by the non-conductive epoxy. The MDD ionizer can act as a MDD detector compatible with a micro electro mechanical system (MEMS). The size of the entire MDD ionizer can be approximately 0.5 centimeter (cm) by 1.0 cm by 0.5 cm. The electrically conductive capillary tube can be utilized as a ground electrode, which is electrically connected to the electronic controller. The electronic controller provides the AC potential of several kilovolts (kV) directly to the ground electrode and the high voltage electrode, after electrical connection is made to the controller.

The plasma can provide enough energy to ionize the sample molecules at a high pressure (i.e. slightly under atmospheric pressure). The high pressure of the plasma can allow the ionized sample molecules to be pushed or pulled into multiple analyzers, which eliminates the need for high power pumps. The electronic controller can control the strength of the plasma discharge to tune its energy for a very soft ionization, which ensures that ionized molecules stay together and do not fragment. The MDD ionizer can enhance the efficiency of the ionization of the sample molecules due to large overlap of the plasma discharge with the flow path of the dielectric barrier.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
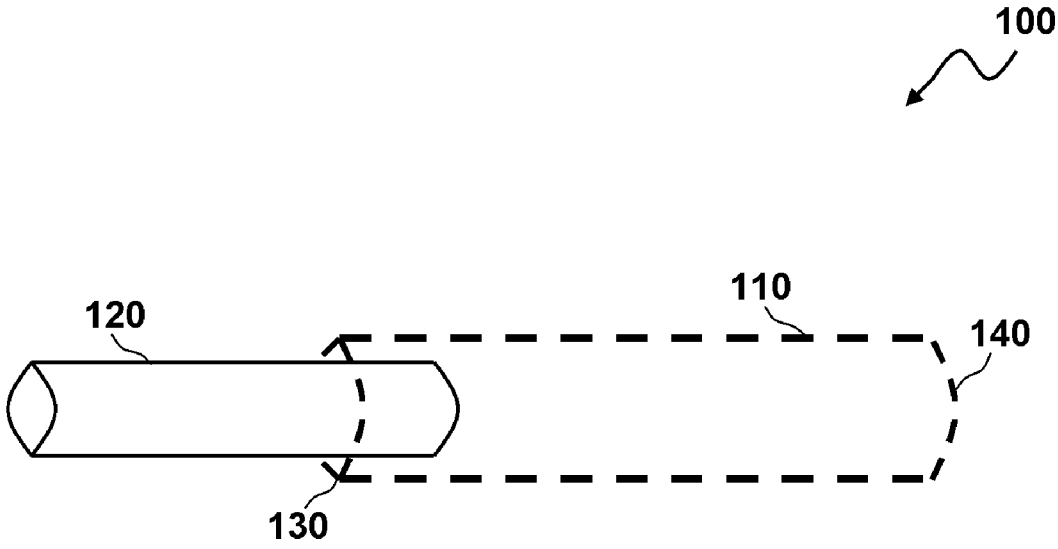
FIGS. 1-6 illustrate a fabrication process of a micro discharge device (MDD) ionizer, which can be implemented in accordance with a preferred embodiment.
Figure 2:
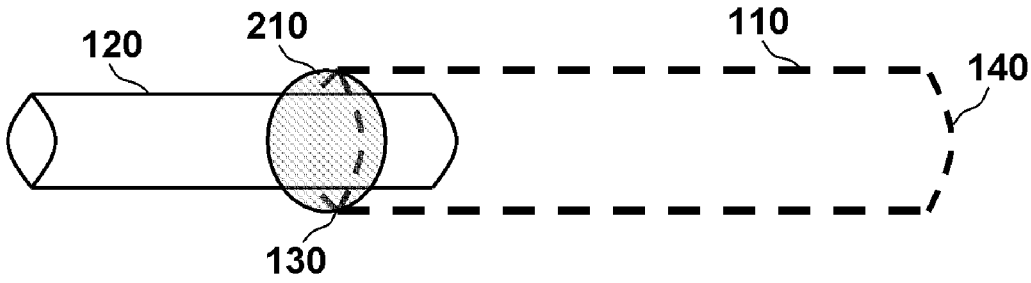
Figure 3:
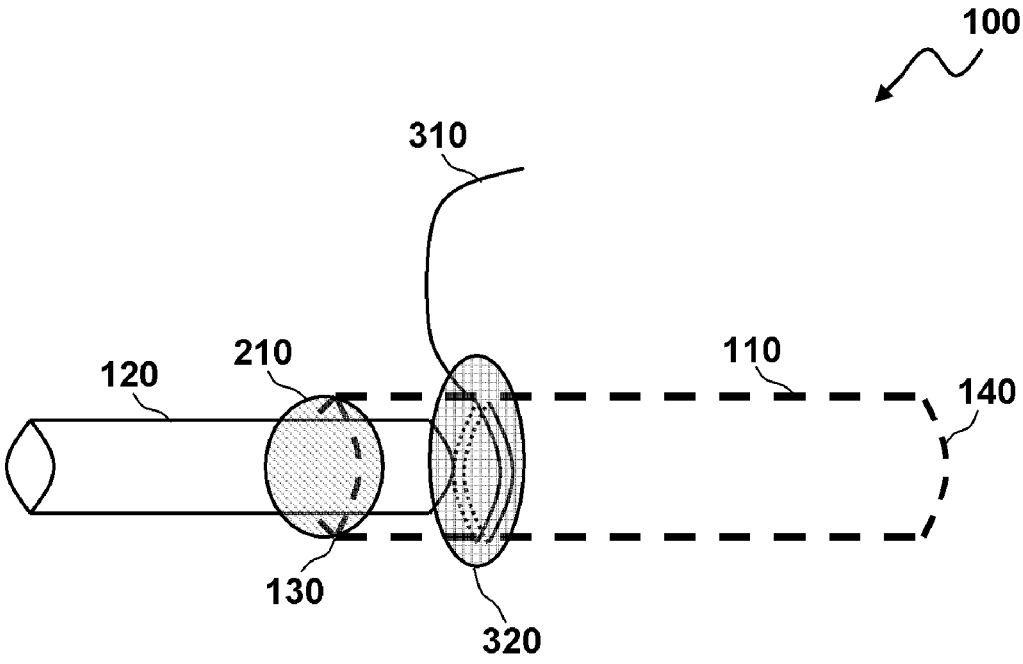

FIGS. 1-6 illustrate a fabrication process of a micro discharge device (MDD) ionizer 100, in accordance with a preferred embodiment. Note that in FIGS. 1-7, identical or similar parts are generally indicated by identical reference numerals. The micro discharge device ionizer 100 can act as a MDD detector 100 compatible with micro electro mechanical systems (MEMS) and can be utilized for soft ionization of sample gaseous molecules at a pressure above high vacuum regions. An electrically conductive capillary tube 120, which acts as a ground electrode, can be inserted at a first open end 130 of a dielectric tube 110, as illustrated at FIG. 1. Next, as depicted at FIG. 2, the electrically conductive capillary tube 120 and first open end 130 of the dielectric tube 110 can be sealed by a high strength epoxy 210. A high voltage electrode 310 can be placed around the dielectric tube 110 and is sealed by a non-conductive epoxy 320, as shown in FIG. 3.

Figure 4:
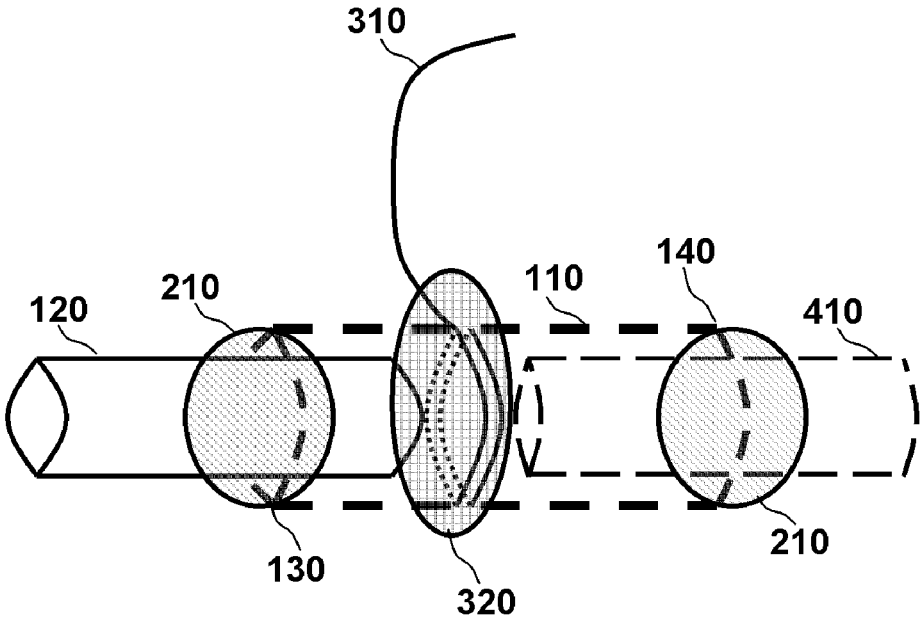
Figure 5:
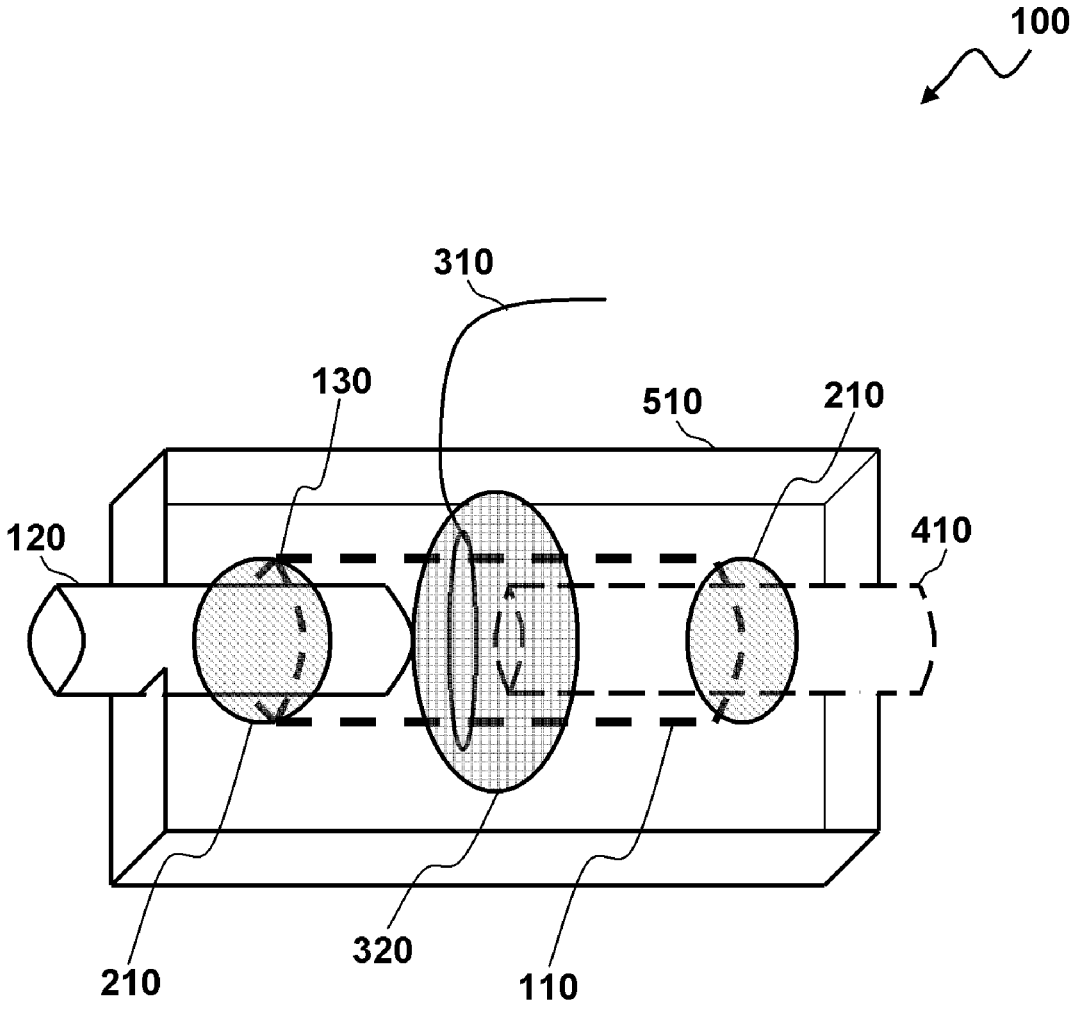
Figure 6:
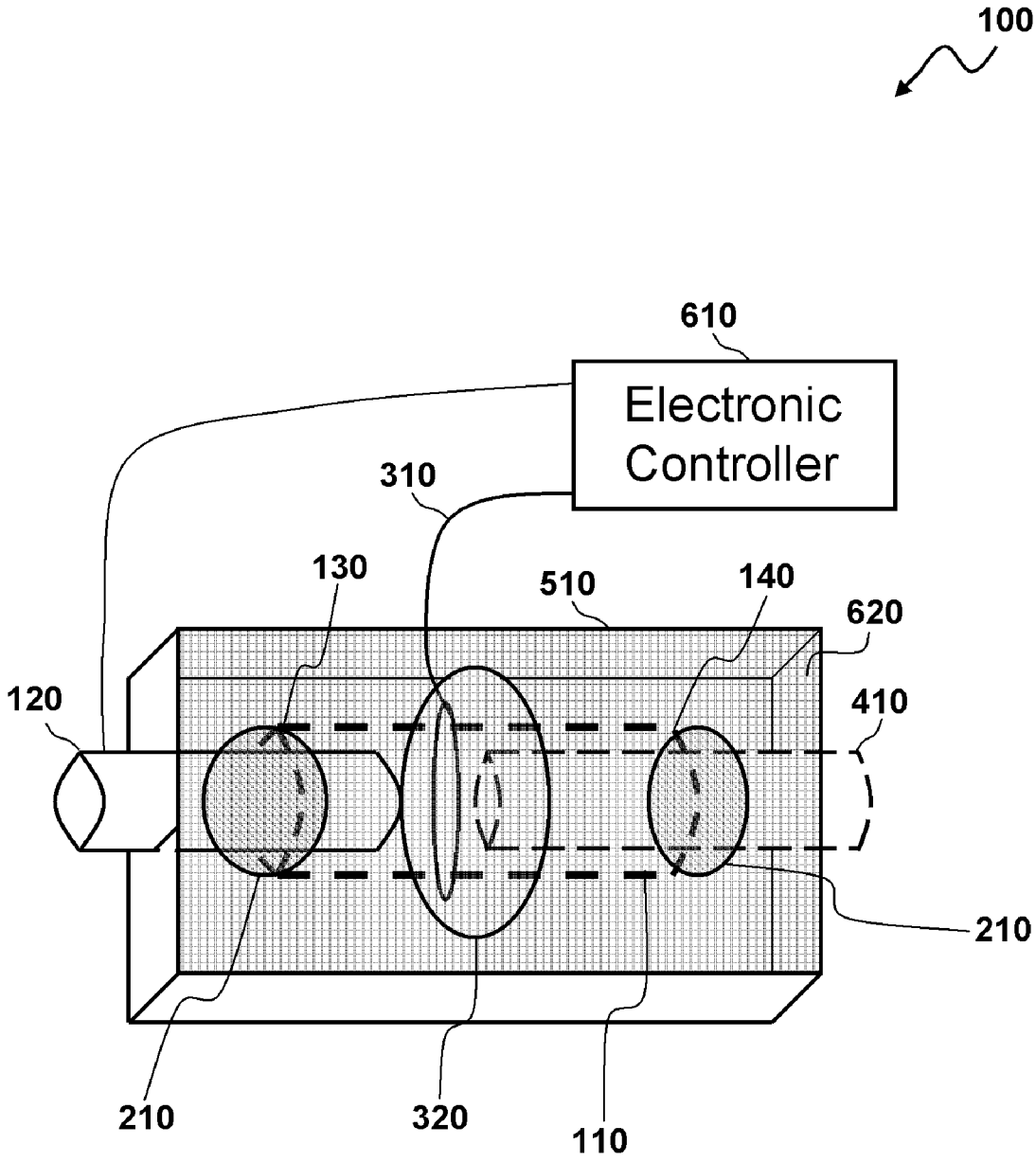

FIG. 4 illustrates a sample collection capillary tube 410 can be inserted at a second open end 140 of the dielectric tube 110. The sample collection capillary tube 410 and the second open end 140 of the dielectric tube 110 can be sealed by a high strength epoxy 210. Thereafter, the entire MDD assembly 100 can be potted in a potting block 510, as depicted in FIG. 5. The electrically conductive capillary 120 and high voltage electrode 310 are connected to an electronic controller 610, as illustrated at FIG. 6. The entire MDD assembly 100 within the potting block 510 can be sealed by a non-conductive epoxy 620, as depicted at FIG. 6.

In addition, the size of the MDD 100 is approximately 0.5 cm by 1.0 cm by 0.5 cm. These dimensions are described for purposes of clarity and specificity; however, they should not be interpreted in any limiting way. It will be apparent to those skilled in the art that other dimensions can also be utilized without departing from the scope of the invention. An (100s of kHz) AC potential of several kilovolts (kV) can be applied to the MDD assembly 100, which creates a plasma discharge in the flow path of the MDD 100. The resulting plasma discharge can achieve soft ionization of the sample molecules in the MDD 100 with respect to high vacuum regions. Note that the high pressure region generally occurs in the plasma region (where the ionization occurs). The ions are drawn (i.e., pushed or pulled) toward the high vacuum region located downstream where the detector(s) can be located.

Figure 7:
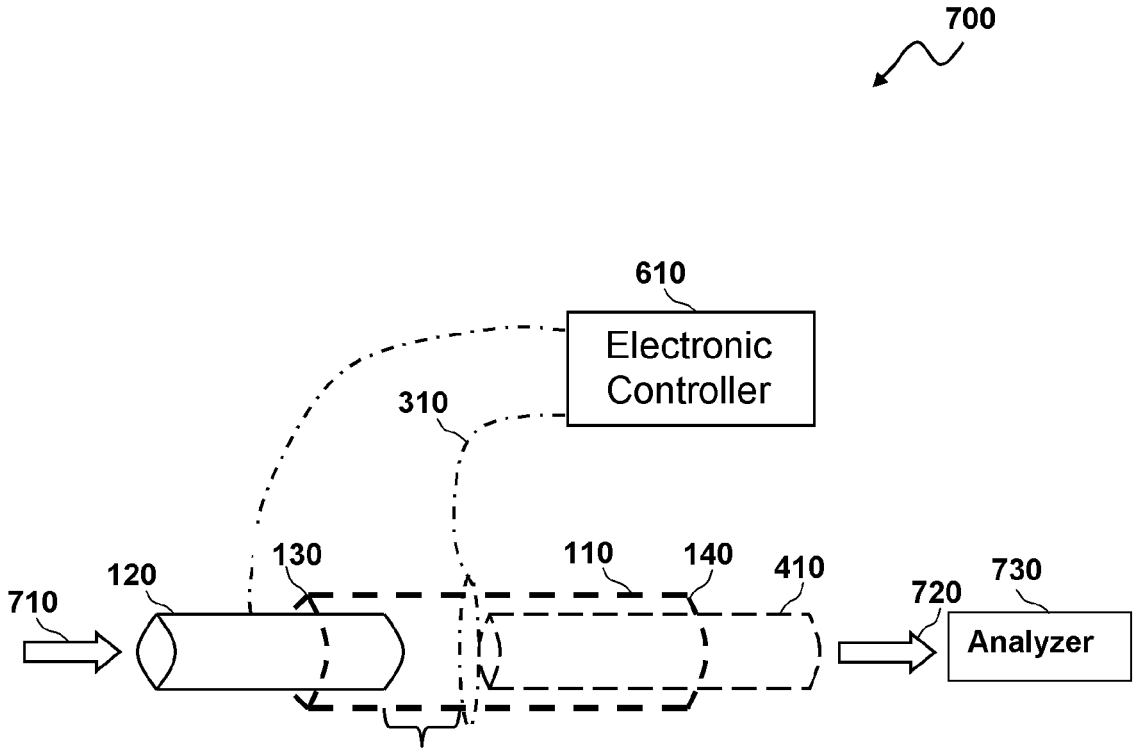
FIG. 7 illustrates a perspective view of a micro discharge device (MDD) ionizer without non-conductive epoxy, which can be implemented in accordance with an alternative embodiment.

FIG. 7 illustrates a perspective view of a MDD ionizer 100 without a non-conductive epoxy 320, which can be implemented in accordance with an alternative embodiment. The MDD 100 can be hermetically sealed at joints formed between a dielectric tube 110, a sample collection capillary tube 410 and an electrically conductive capillary 120. The electrically conductive capillary 120, the dielectric tube 110 and the sample collection capillary tube 410 can be positioned along the center axis of the MDD 100. The dielectric barrier 110 and the capillary tubes 120 and 410 can be adapted for allowing the sample gas to be either pushed or pulled through the MDD 100.

Moreover, a gas sample can be passed through a flow inlet 710 of the MDD 100 for ionizing molecules in the gas sample. Similarly, the ionized gas sample can be emitted out through a flow outlet 720, which is connected to several analyzers 730. A high voltage electrode 310 can be placed in close proximity to the dielectric tube 110. A plasma discharge can be formed inside the dielectric tube 110 between the electrically conductive capillary 120 and the high voltage electrode 310. The plasma discharge can ionize the sample molecules at a pressure slightly under atmospheric. The high pressure allows the ionized sample molecules to be pulled or pushed into multiple analyzers 730 via the flow outlet 720.

Figure 8:
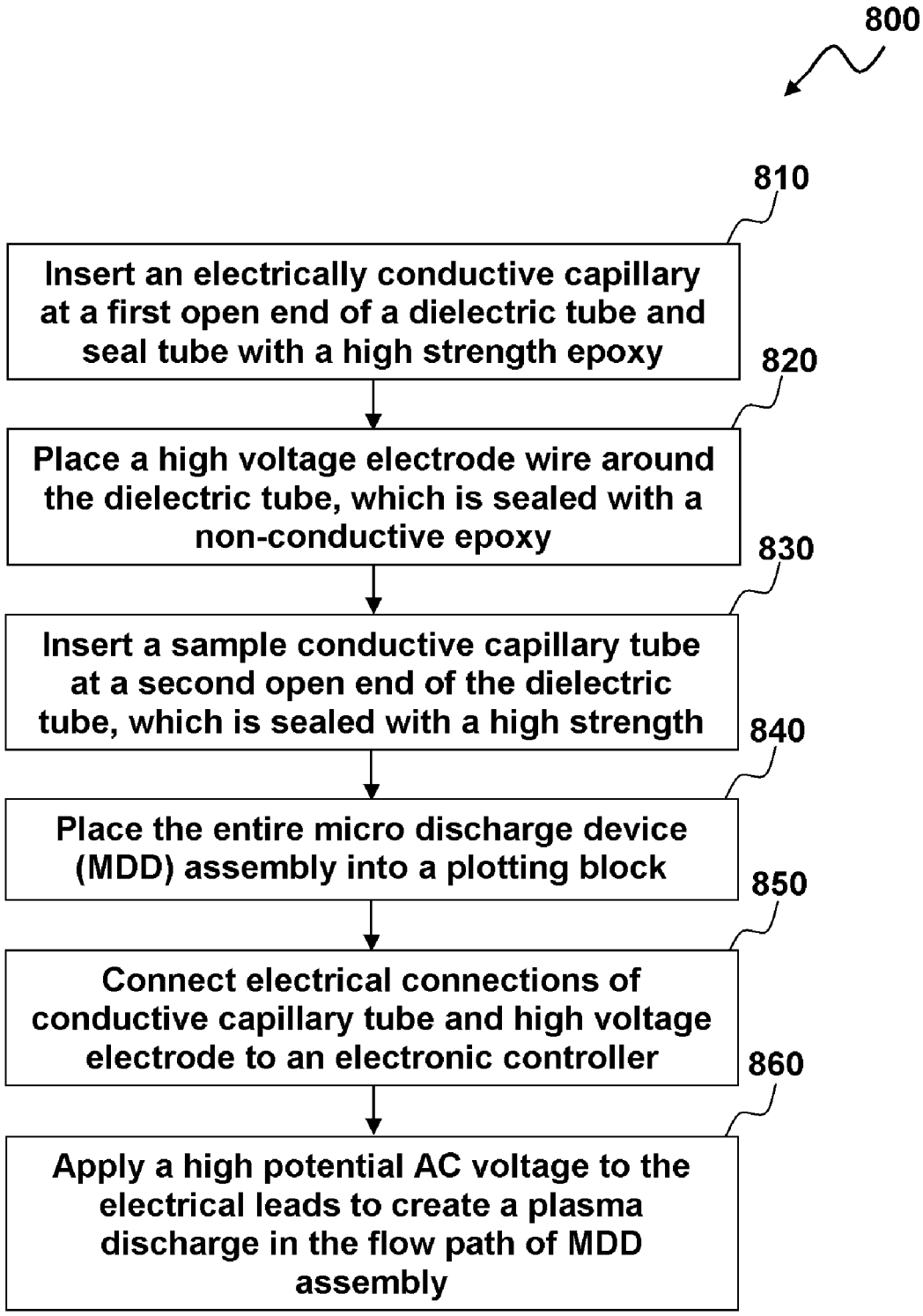
FIG. 8 illustrates a high level flow chart illustrating the fabrication process of a micro discharge device ionizer, which can be implemented in accordance with a preferred embodiment.

FIG. 8 illustrates a high level flow chart 800 illustrating fabrication process of a micro discharge device (MDD) 100, in accordance with a preferred embodiment. An electrically conductive capillary tube (ground electrode) 120 can be inserted into a first open end 130 of a dielectric tube 110, as illustrated at block 810. The electrically conductive capillary tube 120 and the first open end 130 of the dielectric tube 110 can be sealed together by utilizing a high strength epoxy 210. A high voltage electrode 310 can be placed around the dielectric tube 110, which is sealed by utilizing a non-conductive epoxy 320, as depicted at block 820. A sample collection capillary tube 410 can be inserted at a second open end 140 of the dielectric tube 110, which is also sealed by utilizing the high strength epoxy 210, as illustrated at block 830.

As illustrated at block 840, the MDD assembly 100 can be potted into a potting block 510, where the potting block 510 can be sealed with a non-conductive epoxy 320. Electrical connections of the electrically conductive capillary tube 120 and the high voltage electrode 310 are connected to an electronic controller 610, as depicted at block 850. A high potential AC (alternating current) voltage can be applied to the electrical connections to create a plasma discharge in the flow path of the MDD 100, as depicted at block 860. The AC voltage can allow a small current to pass through the dielectric barrier 110 in the form of plasma directly after introducing the sample into the electrically conductive capillary tube 120.

Such a plasma discharge can provide enough energy to ionize the sample molecules under high pressure without the need for high power pumps. The electronic controller 610 can control the strength of the plasma discharge to achieve a very soft ionization, which ensures that the ionized sample molecules stay together and do not fragment. The MDD ionizer 100 can enhance the efficiency of the ionization of the sample molecules due to large overlap of the plasma discharge with the flow path of the dielectric barrier 110.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A micro discharge device (MDD) ionizer apparatus, comprising:

a dielectric barrier that includes a first open end connected to an electrically conductive capillary tube, and a second open end connected to a sample collection capillary tube;

a high voltage electrode positioned around said dielectric barrier in close linear proximity to said electrically conductive capillary tube and sealed by a non-conductive epoxy, wherein said high voltage electrode and said electrically conductive capillary tube are electrically connected to an electronic controller; and a plasma discharge formed in a flow path of said dielectric barrier when an AC potential is applied between said high voltage electrode and said electrically conductive capillary tube, wherein said plasma discharge in said dielectric barrier provides a very soft ionization of multiple sample molecules at a high pressure; and a potting block for housing an MDD ionizer, wherein said potting block is sealed by said non-conductive epoxy, said MDD ionizer comprising an MDD detector compatible with at least one MEMS-based device.

2. The apparatus of claim 1 wherein said electrically conductive capillary tube comprises a ground electrode.

3. The apparatus of claim 1 wherein said first and second open ends, said electrically conductive capillary and said sample collection capillary tube are sealed by a high strength epoxy.

4. The apparatus of claim 1 wherein said electronic controller controls a strength of said plasma discharge with respect to said dielectric barrier.

5. The apparatus of claim 1 wherein said plasma discharge allows said multiple sample molecules to be pushed or pulled into a plurality of analyzers.

6. A micro discharge device (MDD) ionizer apparatus, comprising:

a dielectric barrier that includes a first open end connected to an electrically conductive capillary tube, and a second open end connected to a sample collection capillary tube;

a high voltage electrode positioned around said dielectric barrier in close linear proximity to said electrically conductive capillary tube and sealed by a non-conductive epoxy, wherein said high voltage electrode and said electrically conductive capillary tube are electrically connected to an electronic controller;

a plasma discharge formed in a flow path of said dielectric barrier when an AC potential is applied between said high voltage electrode and said electrically conductive capillary tube, wherein said plasma discharge in said dielectric barrier provides a very soft ionization of multiple sample molecules at a high pressure; and a potting block adapted for housing an MDD ionizer, wherein said potting block is sealed by said non-conductive epoxy.

7. The apparatus of claim 6 wherein said MDD ionizer comprises an MDD detector compatible with at least one MEMS-based device.

8. The apparatus of claim 6 wherein said electrically conductive capillary tube comprises a ground electrode.

9. The apparatus of claim 6 wherein said first and second open ends, said electrically conductive capillary and said sample collection capillary tube are sealed by a high strength epoxy.

10. The apparatus of claim 6 wherein said electronic controller controls a strength of said plasma discharge in said dielectric barrier.

11. The apparatus of claim 6 wherein said plasma discharge allows said multiple sample molecules to be pushed or pulled into a plurality of analyzers.

12. A micro discharge device (MDD) ionizer method, comprising:

configuring a dielectric barrier to include a first open end connected to an electrically conductive capillary tube, and a second open end connected to a sample collection capillary tube;

positioning a high voltage electrode around said dielectric barrier and in close linear proximity to said electrically conductive capillary tube and sealed by a non-conductive epoxy, wherein said high voltage electrode and said electrically conductive capillary tube are electrically connected to an electronic controller; and forming a plasma discharge in a flow path of said dielectric barrier when an AC potential is applied between said high voltage electrode and said electrically conductive capillary tube, wherein said plasma discharge in said dielectric barrier provides a very soft ionization of multiple sample molecules at a high pressure;

adapting a potting block for housing an MDD ionizer; and sealing said potting block by said non-conductive epoxy.

13. The method of claim 12 further comprising configuring said MDD ionizer to comprise an MDD detector compatible with at least one MEMS-based device.

14. The method of claim 12 further comprising configuring said electrically conductive capillary tubes to function as a ground electrode.

15. The method of claim 12 further comprising sealing said first and second open ends, said electrically conductive capillary and said sample collection capillary tube by a high strength epoxy.

16. The method of claim 12 further comprising controlling a strength of said plasma discharge in said dielectric barrier utilizing said electronic controller.

17. The method of claim 12 further comprising permitting said plasma discharge to allow said multiple sample molecules to be pushed or pulled into a plurality of analyzers.

* * * * *